US007427078B1

(12) United States Patent
Humble et al.

(10) Patent No.: US 7,427,078 B1
(45) Date of Patent: Sep. 23, 2008

(54) WHEELCHAIR SWING AWAY SYSTEM

(76) Inventors: Donald L. Humble, 506 3rd St., SW., Mandan, ND (US) 58554; Richard F. Long, 1257 S. Washington St., Bismarck, ND (US) 58504

( * ) Notice: Subject to any disclaimer, the term of this patent is extended or adjusted under 35 U.S.C. 154(b) by 322 days.

(21) Appl. No.: 11/213,540

(22) Filed: Aug. 25, 2005

(51) Int. Cl.
*A61G 5/10* (2006.01)

(52) U.S. Cl. ..... 280/304.1; 248/276.1; 248/279.1

(58) Field of Classification Search ..... 280/304.1, 280/250.1; 180/334; 248/274.1, 276.1, 278.1, 248/281.11, 279.1
See application file for complete search history.

(56) References Cited

U.S. PATENT DOCUMENTS

| | | | | | |
|---|---|---|---|---|---|
| 1,114,948 | A * | 10/1914 | Walker | ..... | 108/5 |
| 4,458,870 | A * | 7/1984 | Duncan et al. | ..... | 248/279.1 |
| 5,246,240 | A | 9/1993 | Romisch et al. | ..... | 280/304.1 |
| 5,326,063 | A * | 7/1994 | Stevens | ..... | 248/282.1 |
| 6,042,064 | A * | 3/2000 | Hong | ..... | 248/118.5 |
| 6,170,598 | B1 * | 1/2001 | Furukawa | ..... | 180/334 |
| 6,220,556 | B1 * | 4/2001 | Sohrt et al. | ..... | 248/279.1 |
| 6,341,821 | B1 * | 1/2002 | Rousseau | ..... | 297/411.36 |
| 6,688,571 | B1 | 2/2004 | Pauls | ..... | 248/282.1 |
| 6,896,231 | B1 * | 5/2005 | Sullivan, Sr. | ..... | 248/311.2 |
| 7,222,826 | B1 * | 5/2007 | Berglund | ..... | 248/188.1 |
| 2004/0085295 | A1 | 5/2004 | Cowen | ..... | 345/161 |

FOREIGN PATENT DOCUMENTS

| | | |
|---|---|---|
| JP | 2002-186649 | 7/2002 |

* cited by examiner

*Primary Examiner*—Tony H. Winner

(57) ABSTRACT

A wheelchair swing away system for providing a wheelchair operator multiple joystick control locations. The wheelchair swing away system includes a first mounting rod attached to a wheel chair by a mounting bracket, a second mounting rod rotatably connected to the first mounting rod through a first pivot pin and a control mount rotatably connected to the second mounting rod through a second pivot pin. The mounting bracket attaches to existing structure of the wheelchair and allows the first mounting rod to slide and rotate within the mounting bracket. The second mounting rod is comprised of a second rod that is rotatably connected to a first rod, with the rods fixed together by a fastener when a desired orientation is obtained.

14 Claims, 13 Drawing Sheets

WHEELCHAIR SWING AWAY SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to adjustable support structures and more specifically it relates to a wheelchair swing away system for providing a wheelchair operator multiple joystick control locations.

2. Description of the Related Art

Any discussion of the prior art throughout the specification should in no way be considered as an admission that such prior art is widely known or forms part of common general knowledge in the field.

Adjustable support structures have been in use for years. Typically, joystick controls for wheelchairs lie to the outside of the armrest (either right or left) and slightly forward of the armrest. The structure used to support the joystick usually has some adjustability to allow the user to locate the joystick in an orientation that best fits them. Unfortunately, the structures currently used to support joystick controls on wheelchairs do not have the range of adjustment to allow the user to situate their wheelchair near a table or work desk.

While these devices may be suitable for the particular purpose to which they address, they are not as suitable for providing a wheelchair operator multiple joystick control locations. Current wheelchair joystick support structures do not permit a full range of adjustability for the user to sit at a table or work station.

In these respects, the wheelchair swing away system according to the present invention substantially departs from the conventional concepts and designs of the prior art, and in so doing provides an apparatus primarily developed for the purpose of providing a wheelchair operator multiple joystick control locations.

BRIEF SUMMARY OF THE INVENTION

In view of the foregoing disadvantages inherent in the known types of adjustable support structures now present in the prior art, the present invention provides a new wheelchair swing away system construction wherein the same can be utilized for providing a wheelchair operator multiple joystick control locations.

The general purpose of the present invention, which will be described subsequently in greater detail, is to provide a new wheelchair swing away system that has many of the advantages of the adjustable support structures mentioned heretofore and many novel features that result in a new wheelchair swing away system which is not anticipated, rendered obvious, suggested, or even implied by any of the prior art adjustable support structures, either alone or in any combination thereof.

To attain this, the present invention generally comprises a first mounting rod attached to a wheel chair by a mounting bracket, a second mounting rod rotatably connected to the first mounting rod through a first pivot pin and a control mount rotatably connected to the second mounting rod through a second pivot pin. The mounting bracket attaches to existing structure of the wheelchair and allows the first mounting rod to slide and rotate within the mounting bracket. The second mounting rod is comprised of a second rod that is rotatably connected to a first rod, with the rods fixed together by a fastener when a desired orientation is obtained.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a wheelchair swing away system that will overcome the shortcomings of the prior art devices.

A second object is to provide a wheelchair swing away system for providing a wheelchair operator multiple joystick control locations.

Another object is to provide a wheelchair swing away system that is easily operated.

An additional object is to provide a wheelchair swing away system that allows a user to sit at a table or desk.

A further object is to provide a wheelchair swing away system that fits on most existing wheelchairs.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
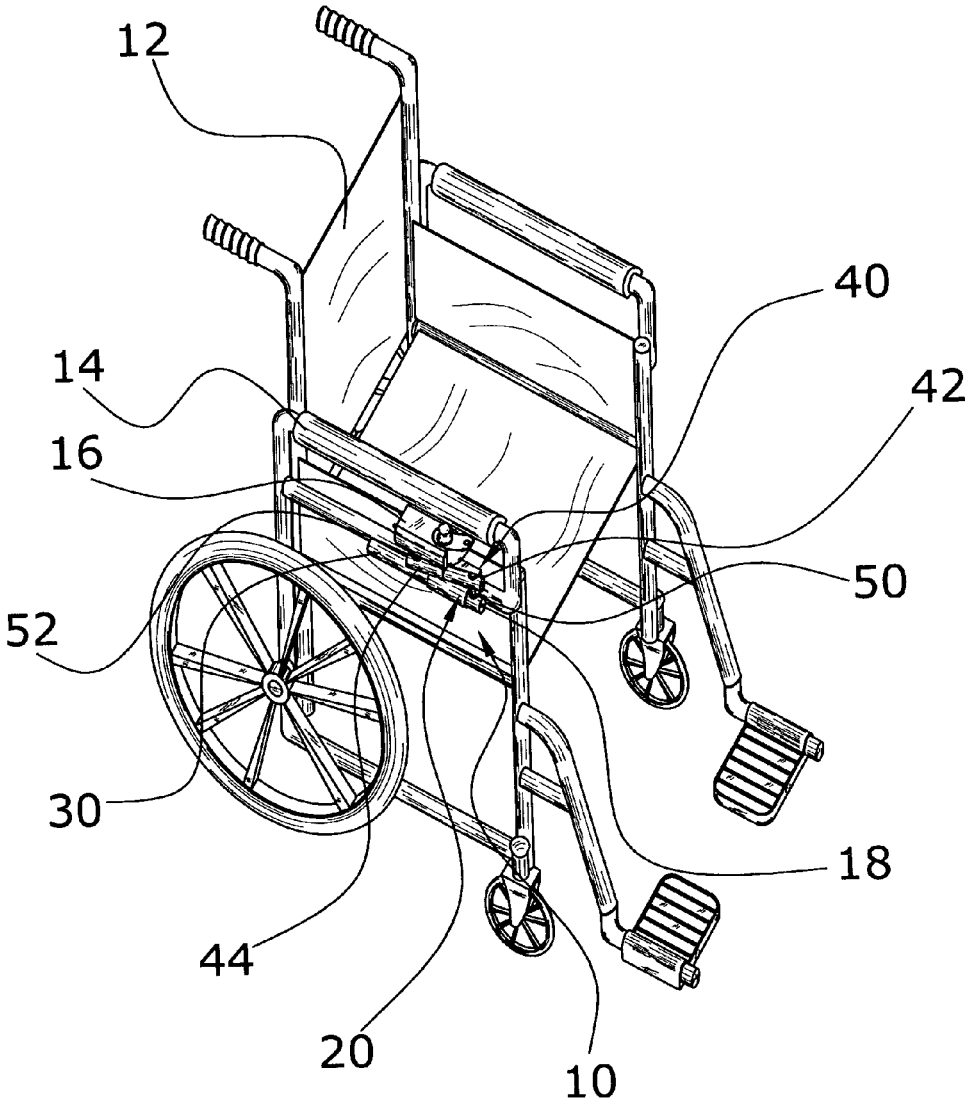
FIG. 1 is an upper perspective view of the present invention in a fully retracted orientation.

Turning now descriptively to the drawings, in which similar reference characters denote similar elements throughout the several views, FIGS. 1 through 11 illustrate a wheelchair swing away system 10, which comprises a first mounting rod 30 attached to a wheel chair 12 by a mounting bracket 20, a second mounting rod 40 rotatably connected to the first mounting rod 30 through a first pivot pin 50 and a control mount 60 rotatably connected to the second mounting rod 40 through a second pivot pin 52. The mounting bracket 20 attaches to existing structure of the wheelchair 12, allowing the first mounting rod 30 to slide and rotate within the mounting bracket 20. The second mounting rod 40 is comprised of a second rod 44 that is rotatably connected to a first rod 42, with the rods 42, 44 fixed together by a fastener 18 when a desired orientation is obtained.

B. Mounting Bracket

The mounting bracket 20 is comprised of a clamp 22 and a tube 24 section. The clamp 22 and tube 24 are preferably made of a rigid material that will not distort when supporting the weight of the wheelchair swing away system 10, a control module 16 and any force a user will additionally apply. The mounting bracket 20 components 22, 24 are preferably metal, however, are not restricted from being molded in a plastic or a composite material.

The clamp 22 is preferably adjustable in order to fit various sized wheelchair structure. As shown in FIGS. 3 through 8, the clamp 22 is positioned on an existing tubular structure of a wheelchair 12 and can be adjusted fore and aft to best fit the users' needs. As can be appreciated, wheelchairs 12 can be constructed in many ways and as a result the mounting bracket 20 can be attached in several different manners.

The tube 24 is attached, preferably welded, to the clamp, but it can be appreciated that other forms of attachment (e.g. fasteners or molded) could be utilized. The tube 24 is sized to securely accept a first mounting rod 30 extending through it, yet allow sliding and rotating of the first mounting rod 30 for user adjustment. A fastener 18 may extend through both the tube 24 and first mounting rod 30 to ensure that no sliding or rotating of the first mounting rod 30 will occur during use of the wheelchair swing away system 10.

C. Mounting Rods

The first mounting rod 30 and second mounting rod 40 are preferably made of a rigid material that will not distort when supporting the weight of the wheelchair swing away system 10, the control module 16 and any force the user will additionally apply. The mounting rods 30, 40 are preferably metal (e.g. stainless steel) however, are not restricted from being a plastic or a composite material. The mounting rods 30, 40 preferably have a circular cross-sectional shape, but it can be appreciated that other shapes (e.g. square) could also be utilized.

Figure 5:
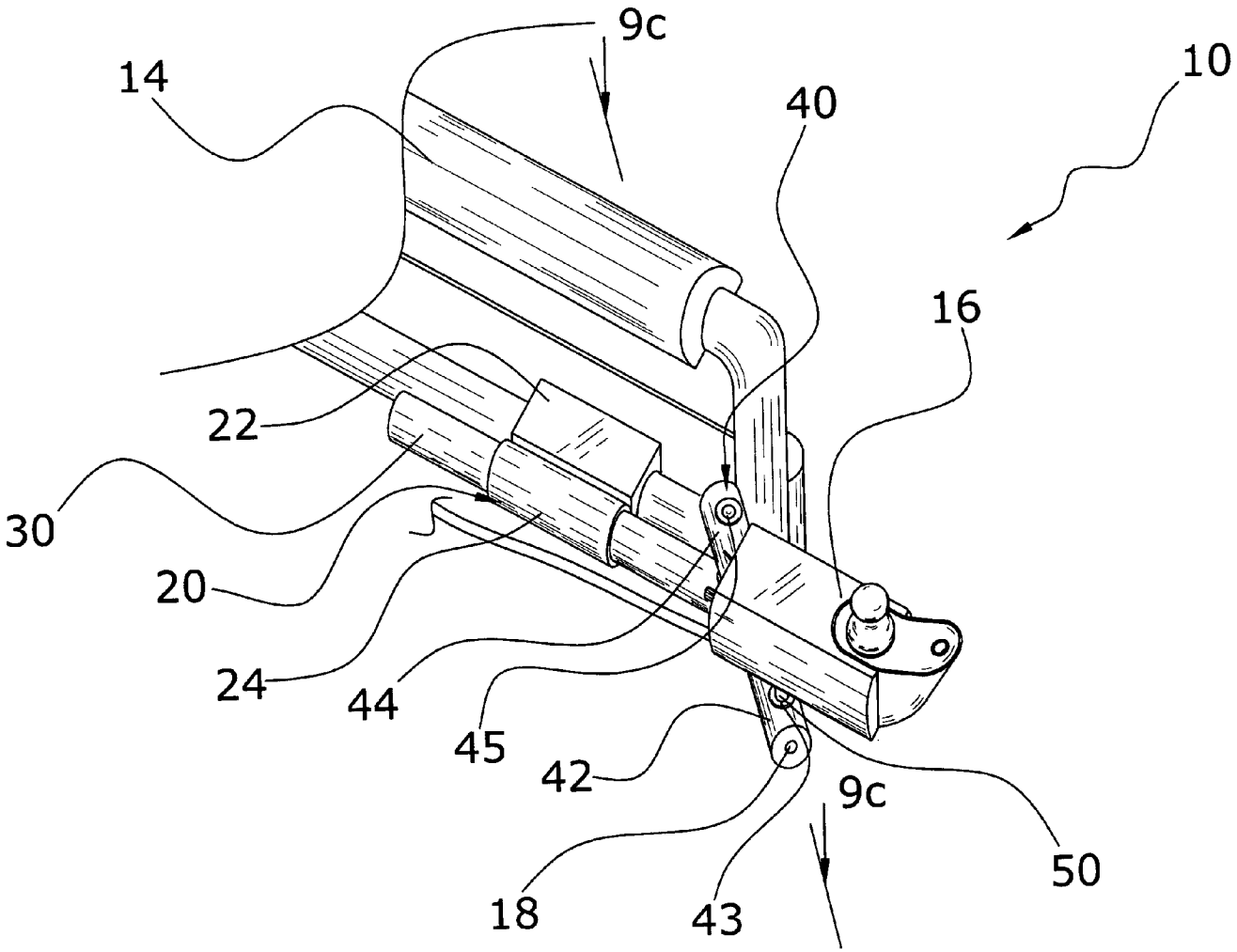
FIG. 5 is a magnified upper perspective view of the present invention with the second mounting rod orientated forward and the second mounting rod rotated 45 degrees outward.
Figure 6:
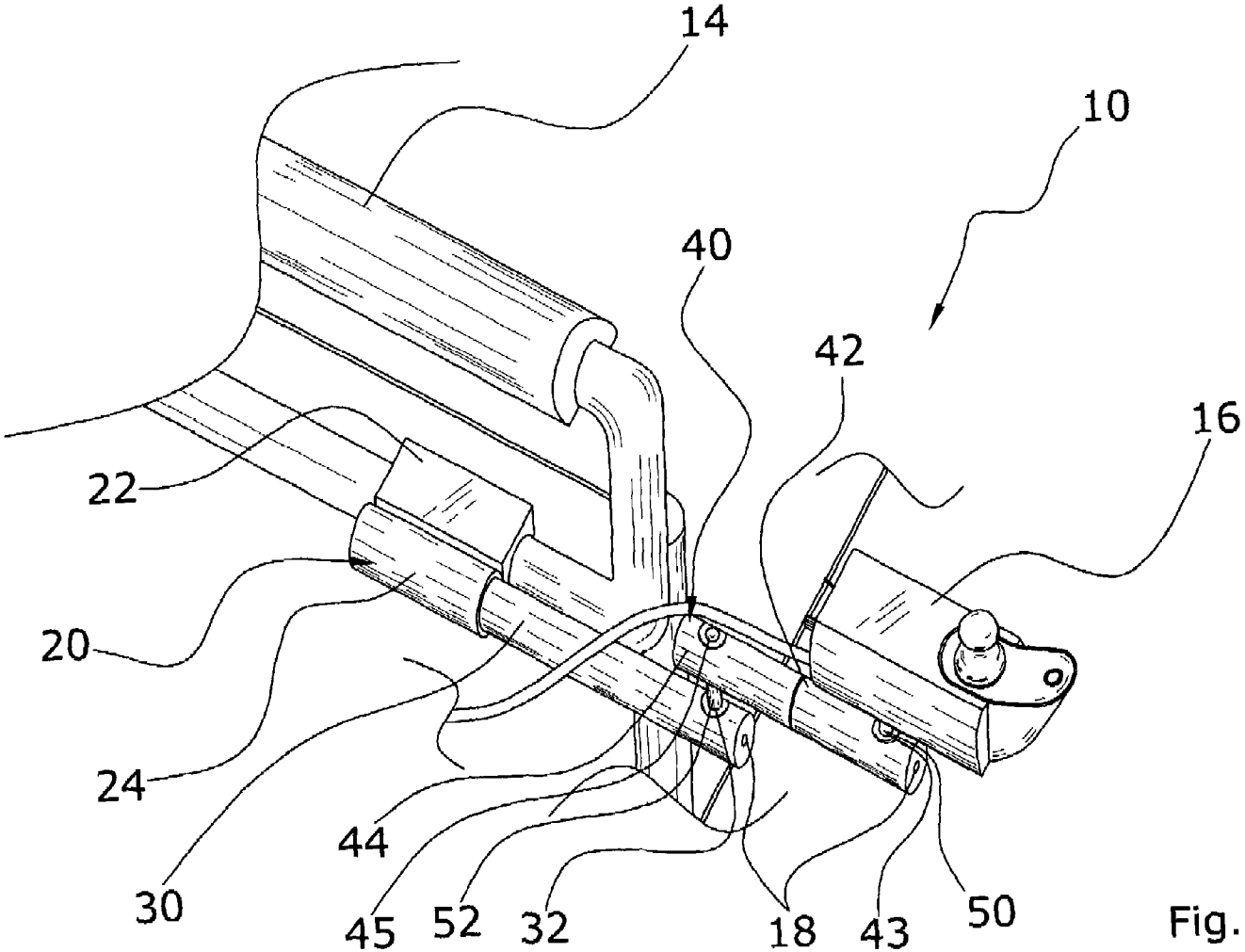
FIG. 6 is a magnified upper perspective view of the present invention in a fully extended orientation.

The first mounting rod 30 is approximately 8 to 10 inches in length, but it can be appreciated that longer or shorter lengths could be utilized as required or desired by the user. As best shown in FIGS. 5 and 6, the first mounting rod 30 is able to slide along its length fore and aft within the mounting bracket 20 tube 24 to provide adjustment to the user. The first mounting rod 30 is also able to rotate within the mounting bracket 20 tube 24 to provide additional adjustment to the user.

As shown in FIGS. 3 through 8, the first mounting rod 30 has a pin aperture 32 extending radially through it, near one end for accepting a second pivot pin 52. An additional threaded aperture extends axially into the first mounting rod 30 and into the pin aperture 32 for accepting a fastener 18 to keep the second pivot pin 52 from sliding out of the pin aperture 32.

Figure 7:
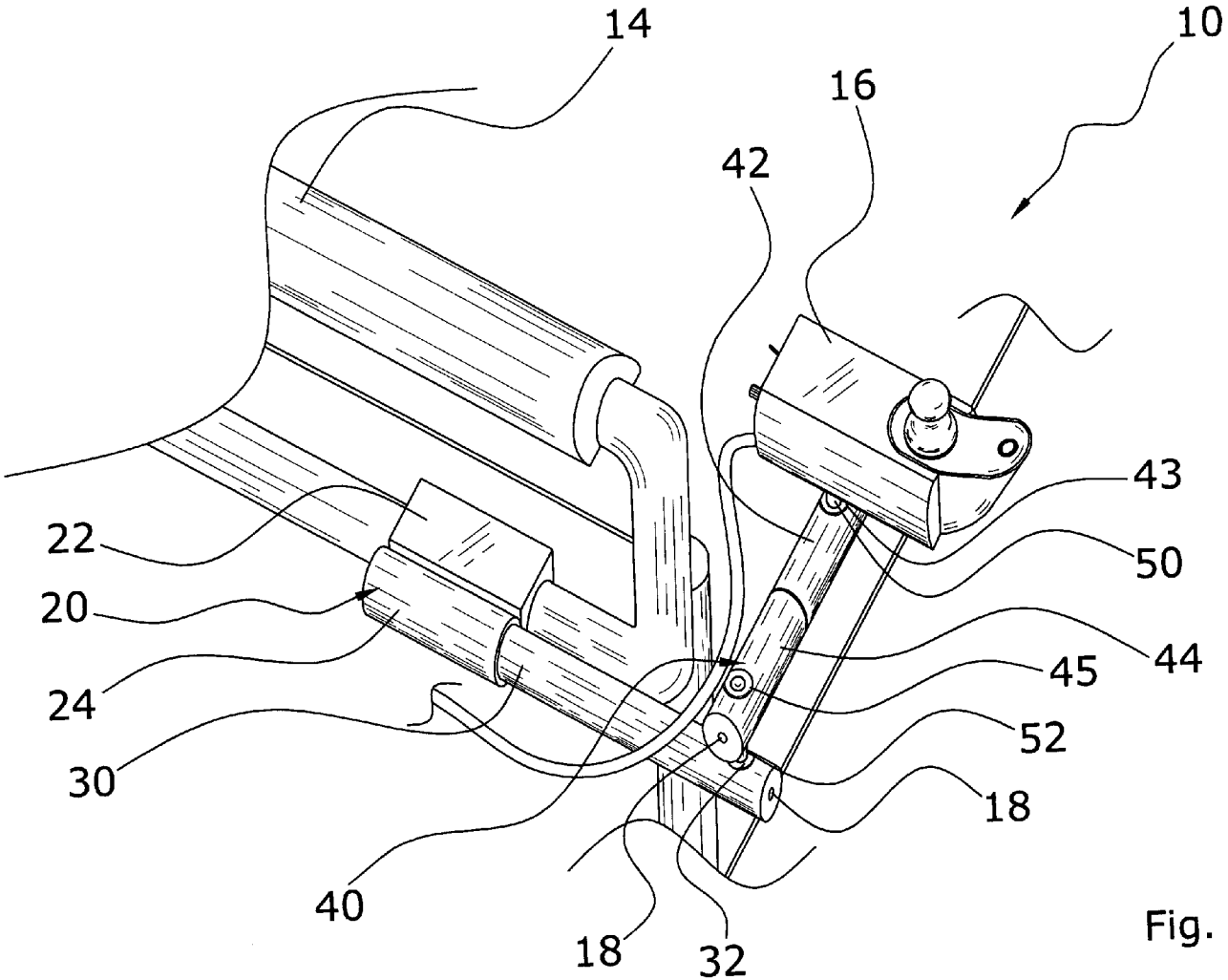
FIG. 7 is a magnified upper perspective view of the present invention with the first mounting rod fully extended and the second mounting rod rotated 90 degrees inward.
Figure 8:
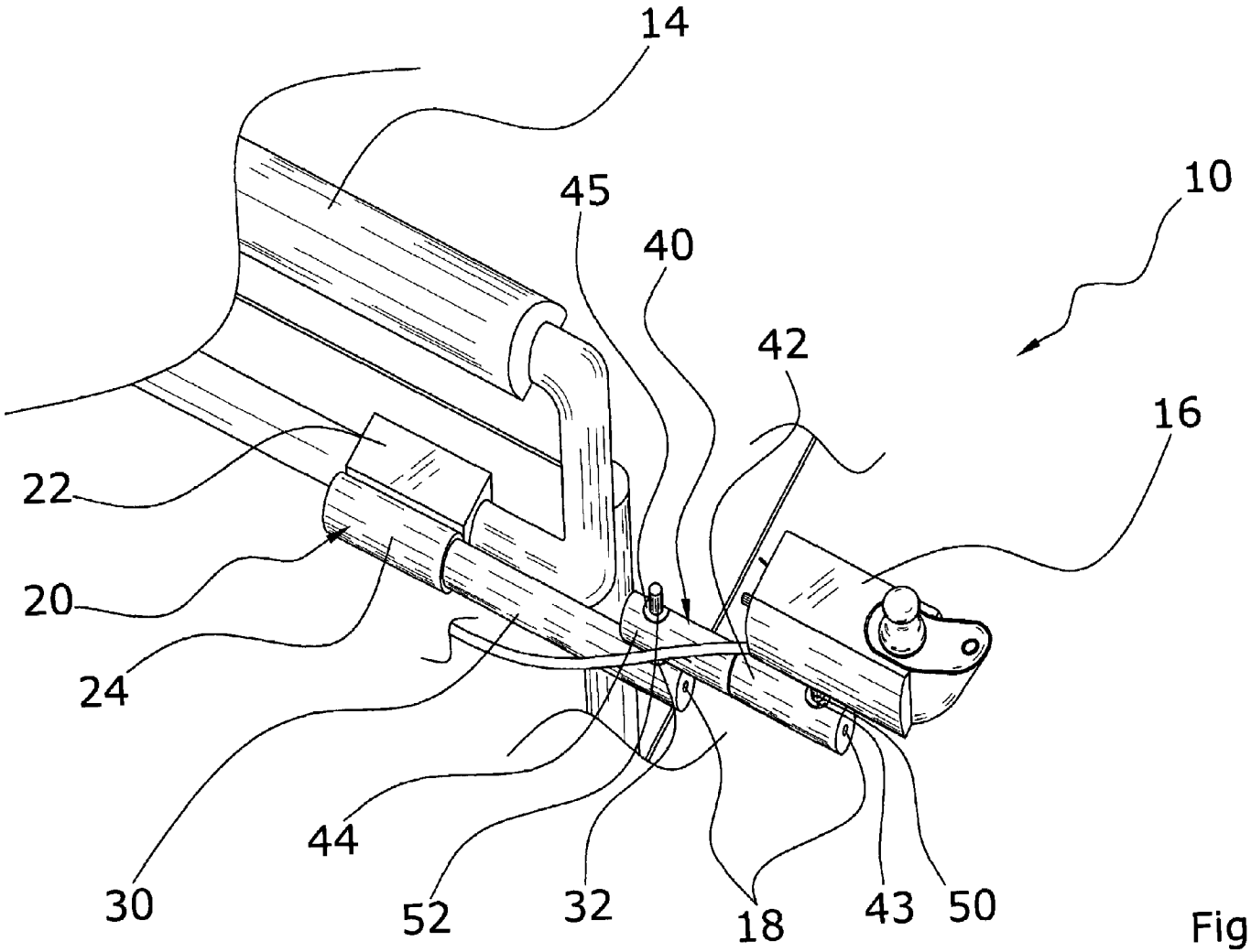
FIG. 8 is a magnified upper perspective view of the present invention with the first mounting rod fully extended and the second mounting rod lowered on the first pivot pin.
Figure 9A:
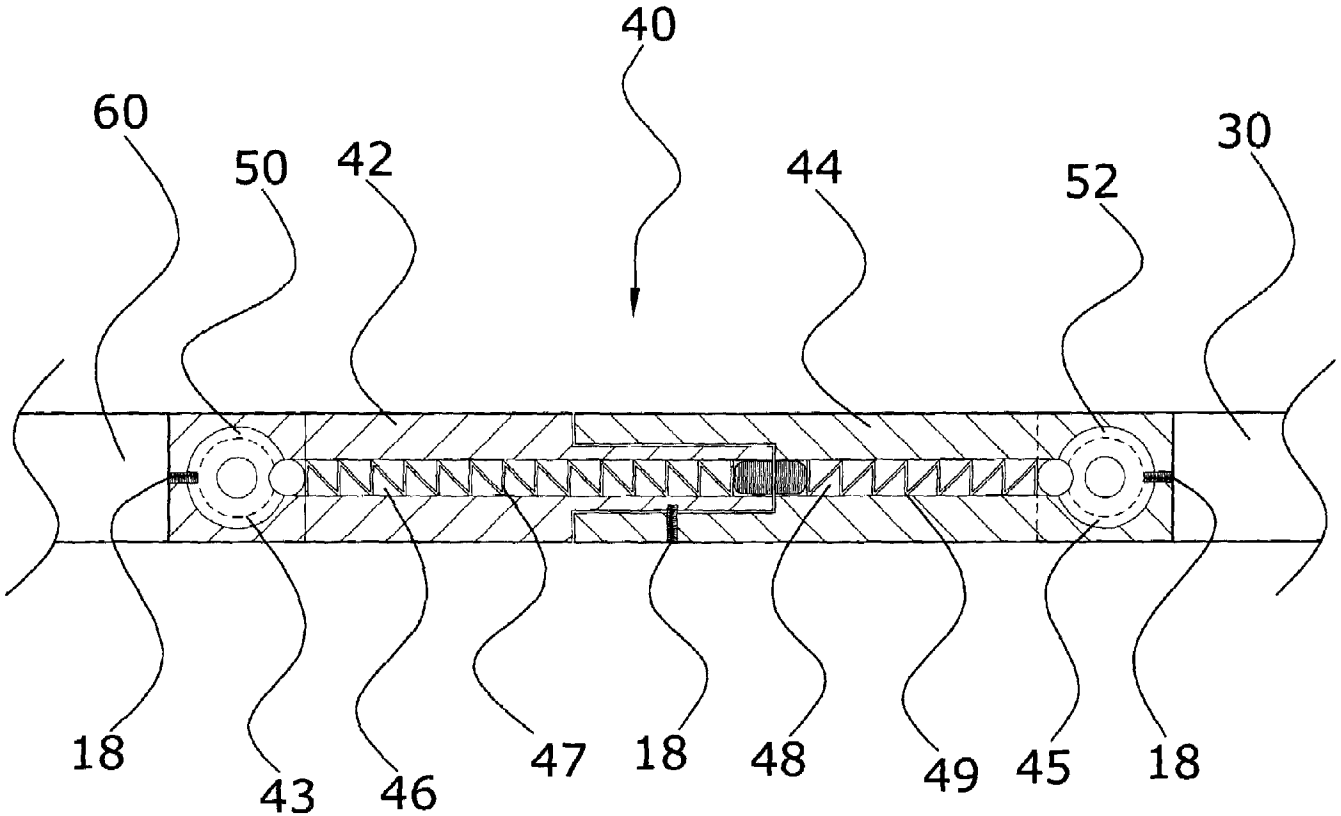
FIG. 9*a* is a detailed view of the inner workings of the second mounting rod.
Figure 9B:
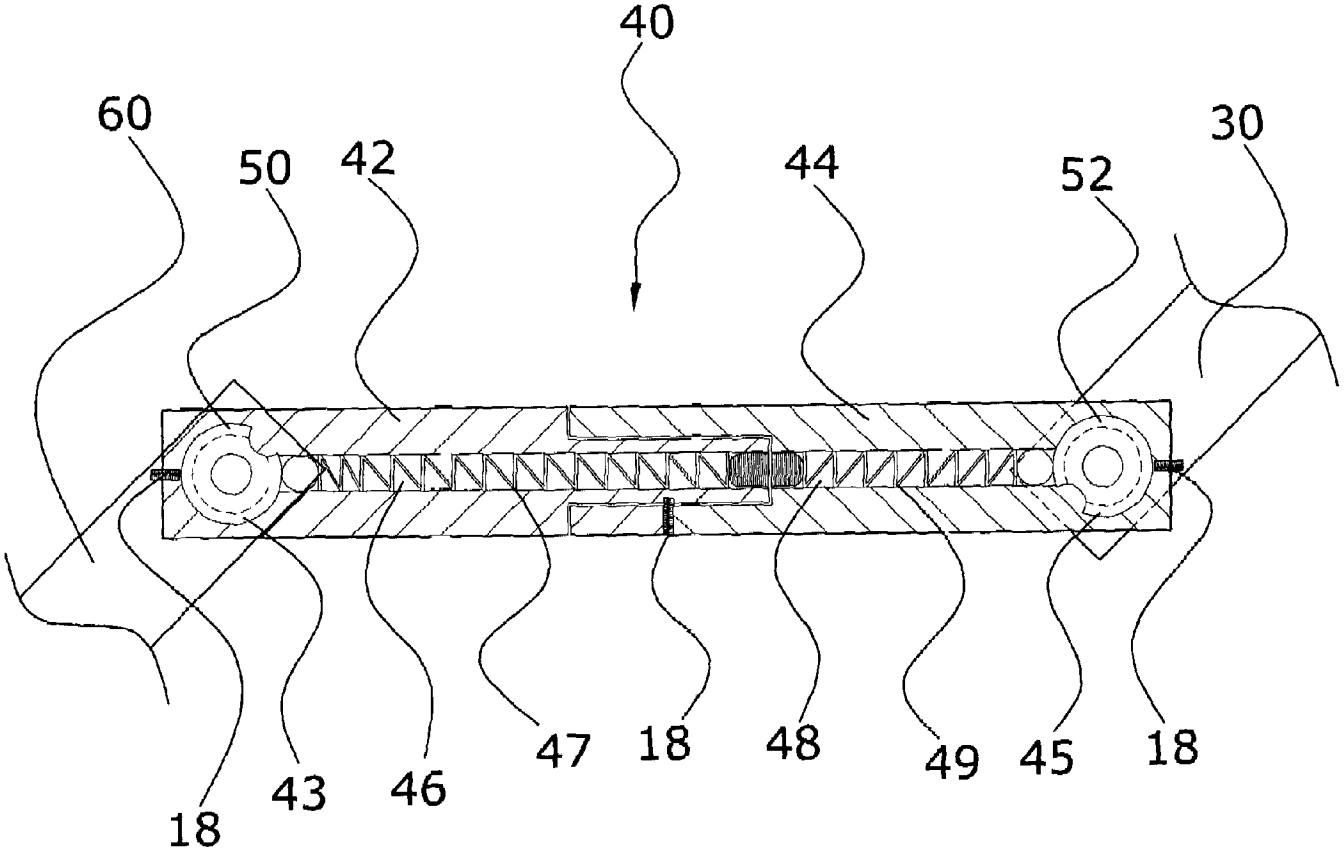
FIG. 9*b* is a detailed view of the inner workings of the second mounting rod with the first mounting rod and control mount differently orientated.
Figure 9C:
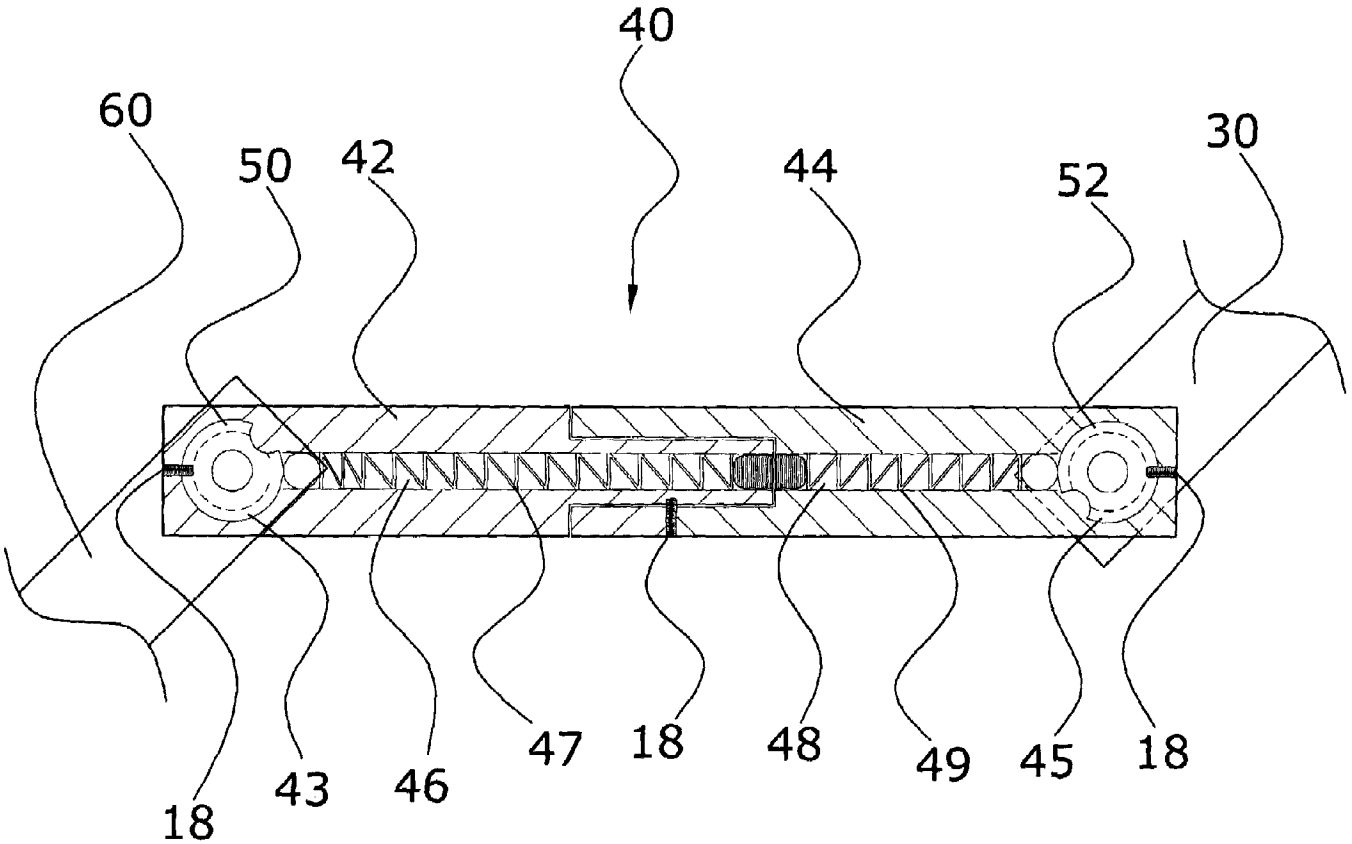
FIG. 9*c* is a detailed view of the inner workings of the second mounting rod with the first mounting rod and control mount differently orientated and fasteners in place.

The second mounting tube 40 is also approximately 8 to 10 inches in length as shown in FIGS. 1 through 9*c*. However, the second mounting tube 40 is comprised of a first rod 42 and a second rod 44 as best shown in FIGS. 9*a* through 9*c*. The second mounting tube 40 provides the user with both angular and rotational adjustment inwardly and outwardly from the wheelchair 12.

As best shown in FIGS. 9*a* through 9*c*, the first rod 42 is externally threaded at one end and has a first aperture 43 extending radially through and near the other end for accepting a first pivot pin 50. Extending axially into the threaded end of the first rod 42 towards and into the first aperture 43 is a first spring aperture 46 for accepting a first spring 47. The first spring 47 is part of a detent mechanism further comprised of an end plug and detent ball used for orientating and retaining the first pivot pin 50. Opposite of the threaded end is an additional threaded aperture extending axially into the first rod 42 and into the first aperture 43 for accepting a fastener 18 to keep the first pivot pin 50 from sliding out of the first aperture 43.

As best shown in FIGS. 9*a* through 9*c*, the second rod 44 is internally threaded at one end to match the threading on the first rod 42 and has a second aperture 45 extending radially through and near the other end for accepting a second pivot pin 52. Extending axially from the threaded end of the second rod 44 towards and into the second aperture 45 is a second spring aperture 48 for accepting a second spring 49. The second spring 49 is part of a detent mechanism further comprised of an end plug and detent ball used for orientating and retaining the second pivot pin 52. Opposite of the threaded end is an additional threaded aperture extending axially into the second rod 44 and into the second aperture 45 for accepting a fastener 18 to keep the second pivot pin 52 from sliding out of the first aperture 45.

Figure 3:
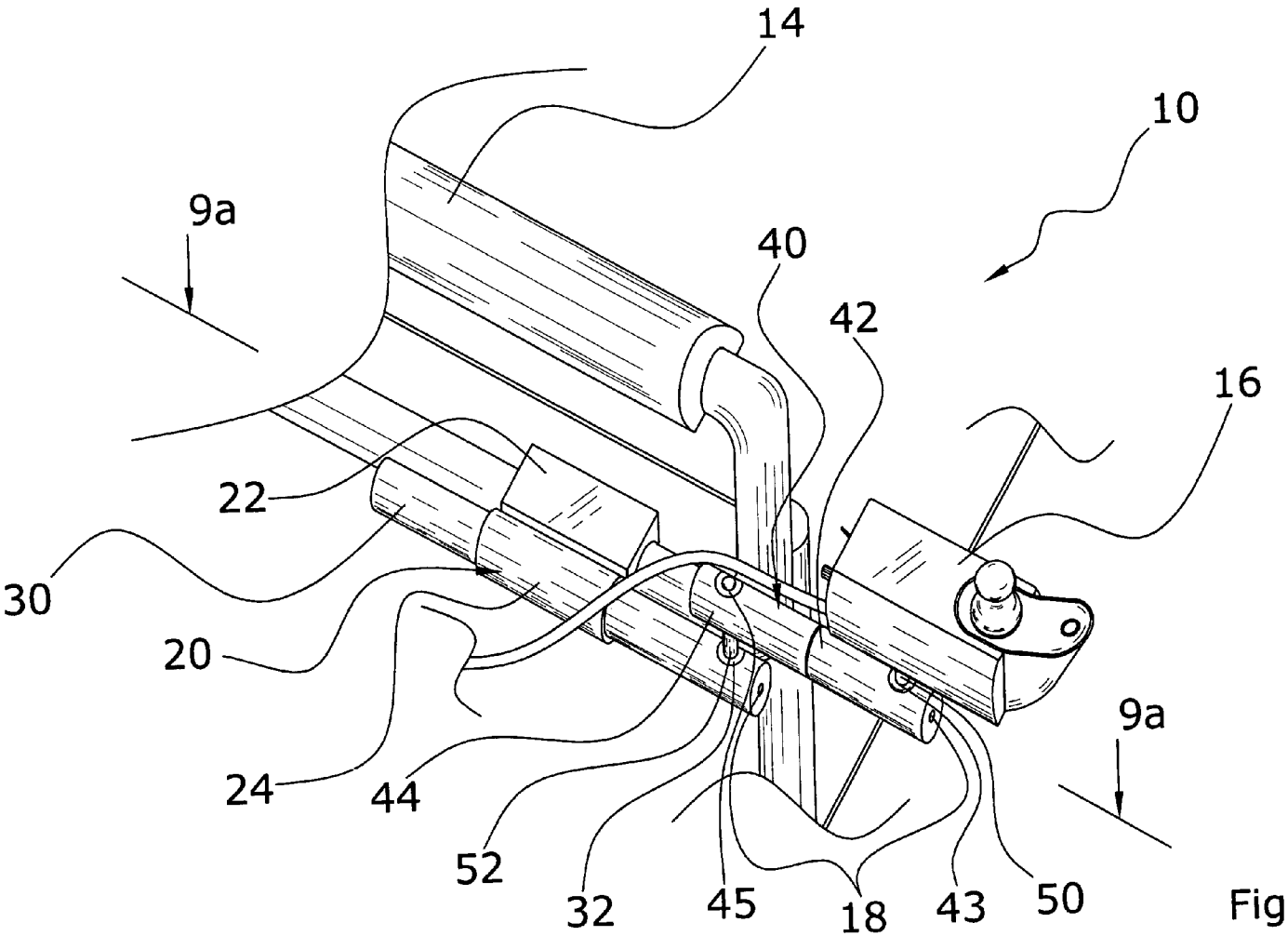
FIG. 3 is a magnified upper perspective view of the present invention with the second mounting rod orientated forward.
Figure 4:
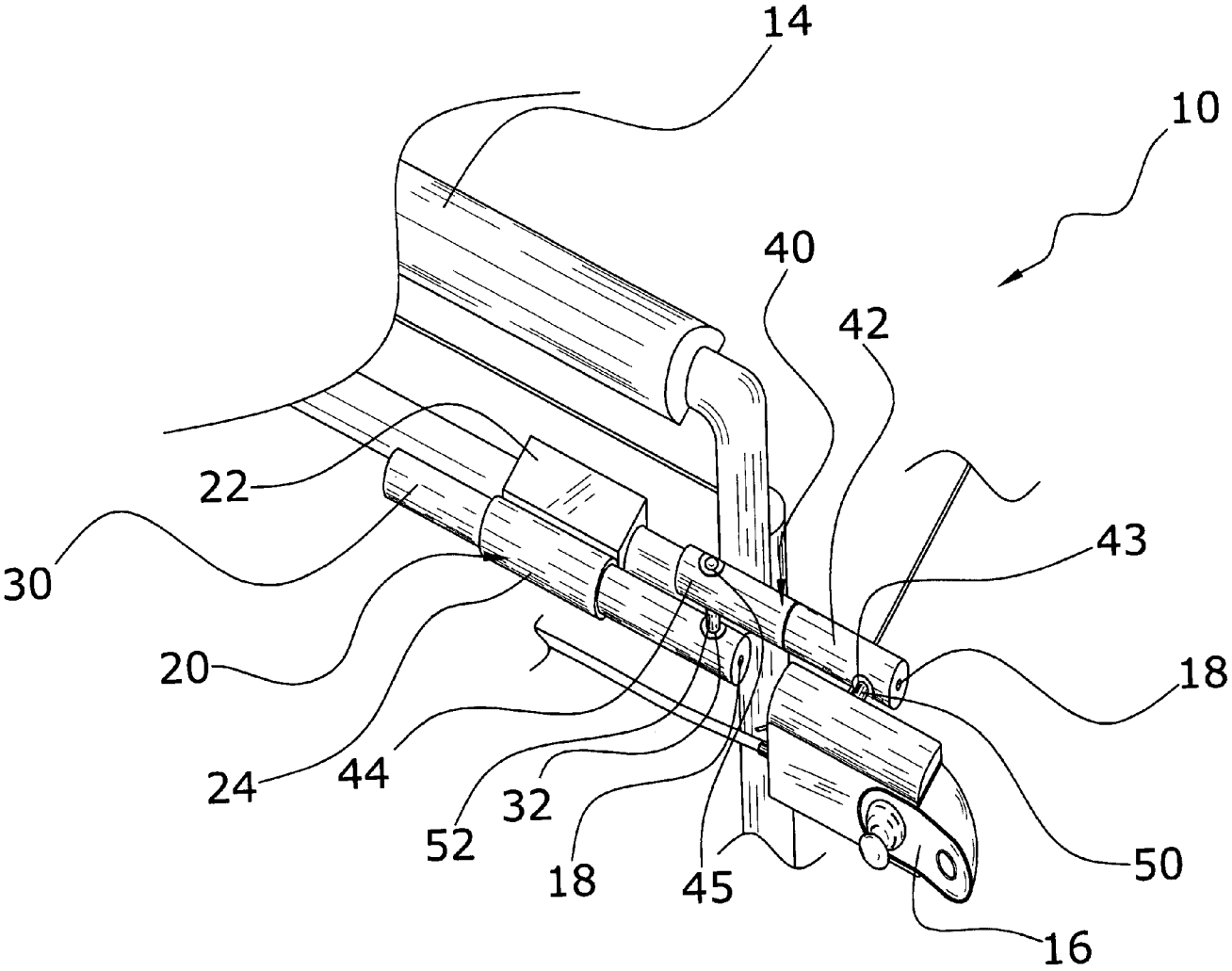
FIG. 4 is a magnified upper perspective view of the present invention with the second mounting rod orientated forward and the first rod rotated 90 degrees.

As shown in FIGS. 9*a* through 9*c*, the first rod 42 and second rod 44 are connected together at their respective threaded ends to create the second mounting rod 40. The threading of the rods 42, 44 allows for rotational adjustability of the second mounting rod 40 as best shown in FIGS. 3 and 4. As shown in FIG. 4, once the desired orientation of the control module 16 is obtained, the second rod 44 is secured with a fastener 18 extending through the second rod 44 and contacting the first rod 42 as best shown in FIGS. 9*a* through 9*c*.

The control mount 60 is preferably approximately 4 to 5 inches in length, but it can be appreciated that longer or shorter lengths could be utilized as required by the particular control module 16 chosen. The control mount 60 could alternatively be a plate like structure for mounting the control module 16. As shown in FIGS. 3 through 8, the control mount 60 requires an aperture to extend radially through it, near one end for accepting the second pivot pin 52. An additional threaded aperture extends axially into the first control mount 60 and into the aperture for accepting a fastener 18 to keep the second pivot pin 52 from sliding out of the aperture.

D. Pivot Pins

The first pivot pin 50 and second pivot pin 52 are preferably made of a rigid material that will not distort when supporting the weight of the wheelchair swing away system 10, the control module 16 and any force the user will additionally apply. The pivot pins 50, 52 are preferably metal (e.g. stainless steel) and have a circular cross-section.

As shown in FIGS. 1 through 9*c*, the first pivot pin 50 is diametrically sized to fit within both the first aperture 43 of the first rod 42 and the pin aperture 32 in the first mounting rod 30 with little radial movement. The second pivot pin 52 is diametrically sized to fit within both the second aperture 45 of the second rod 44 and the aperture in the control mount 60 with little radial movement. Both pivot pins 50, 52 are preferably of length to extend through either both mounting rods 30 and 40 or through the second mounting rod 40 and control mount 60 and allow for axial adjustment, approximately 2 inches, of either the second mounting rod 40 or control mount 60.

Both pivot pins 50, 52 preferably have a feature for receiving a detent ball for proper alignment of the mounting rods 30, 40 and the control mount 60 as shown in FIGS. 3 and 6. As best shown in FIGS. 9*a* through 9*c*, both pivot pins 50, 52 preferably have a groove feature for accepting a fastener 18 to keep the pivot pins 50, 52 from sliding out of their respective apertures 43, 45, 32.

E. Operation of the Invention

In use, the wheelchair swing away system 10 is utilized for supporting a control module 16, preferably a joystick control. However, it can be appreciated that other devices (e.g. monitors or remotes) could possibly be supported by the wheelchair swing away system 10. As shown in FIGS. 1 through 8, the wheelchair swing away system 10 is mounted to the outside of a wheelchair 12 armrest 14 by means of a mounting bracket 20.

Figure 2:
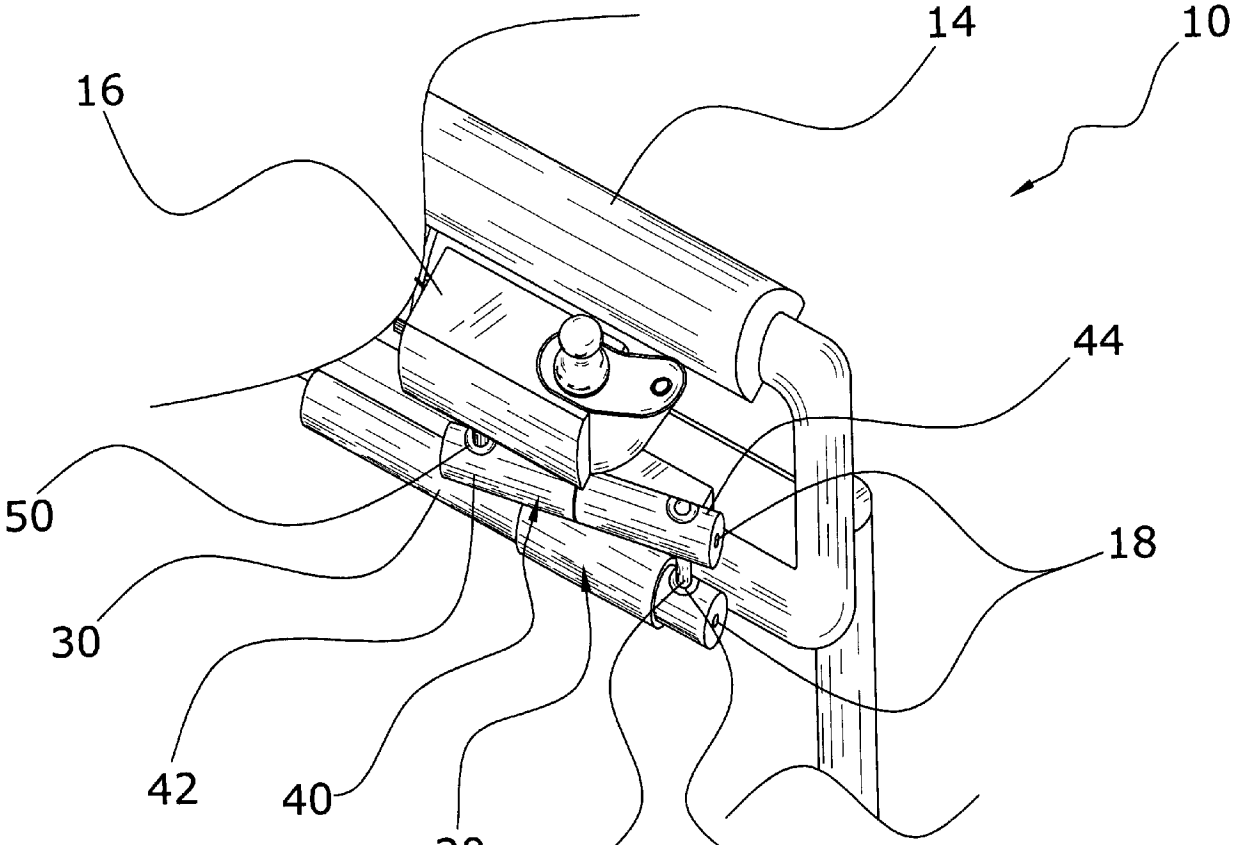
FIG. 2 is a magnified upper perspective view of the present invention in a fully retracted orientation.

As shown in FIGS. 1 and 2, the wheelchair swing away system 10 is in a fully retracted orientation. This orientation is obtained by sliding the first mounting rod 30 fully rearward towards the back of the wheelchair 12 and pivoting the second mounting rod 40 about the second pivot pin 52 towards the rear of the wheelchair also. In the fully retracted orientation, the user would be able to position the wheelchair 12 close to a table or desk without being limited by the control module 16.

As shown in FIGS. 3 and 6, the wheelchair swing away system 10 is in an extended orientation. This orientation is obtained by sliding the first mounting rod 30 forward as desired and pivoting the second mounting rod 40 to the front of the wheelchair 12. In this orientation, the wheelchair swing away system 10 is considered to be in the "normal" operating position, with the detent mechanism within the second mounting rod 40 being utilized to "lock" the wheelchair swing away system 10 in place. As shown in FIG. 8, the wheelchair swing away system 10 can be adjusted vertically as desired by the user by moving the second mounting rod 40 or control mount 60 along either pivot pin 50, 52.

Additional positions of the wheelchair swing away system 10 can be obtained as shown in FIGS. 4, 5 and 7. As shown in FIG. 4, the first rod 42 of the second mounting rod 40 is rotated 90 degrees outward to allow for better ingress and egress to and from the wheelchair 12. As shown in FIG. 5, the second mounting rod 40 is angled 45 degrees outward from the wheelchair 12 for a more desirable user operating position. As shown in FIG. 7, the second mounting rod 40 is rotated 90 degrees inward to create more outside clearance for loading into a vehicle or similar operation.

Figure 10:
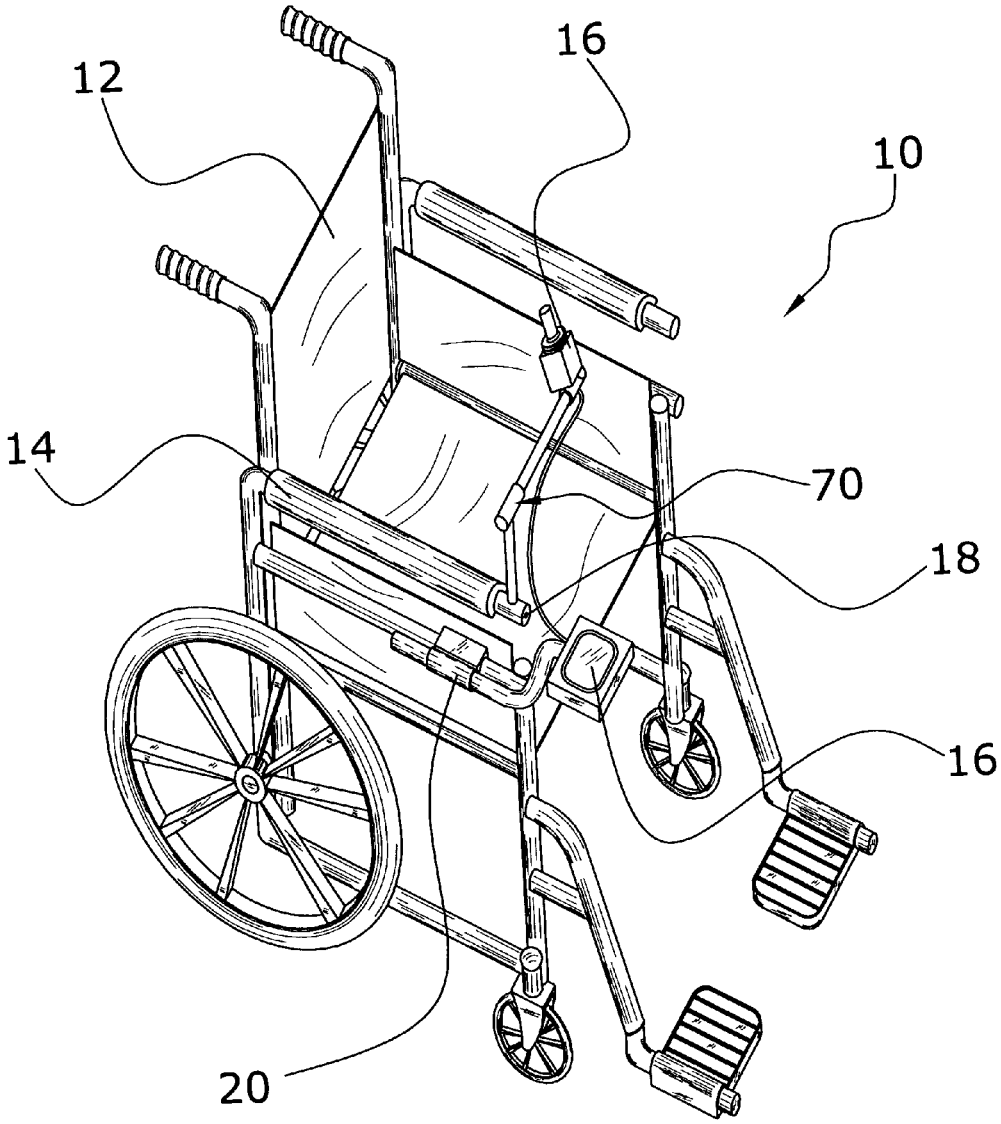
FIG. 10 is an upper perspective view of the present invention in an alternative embodiment showing the extension mount orientated 90 degrees inward.
Figure 11:
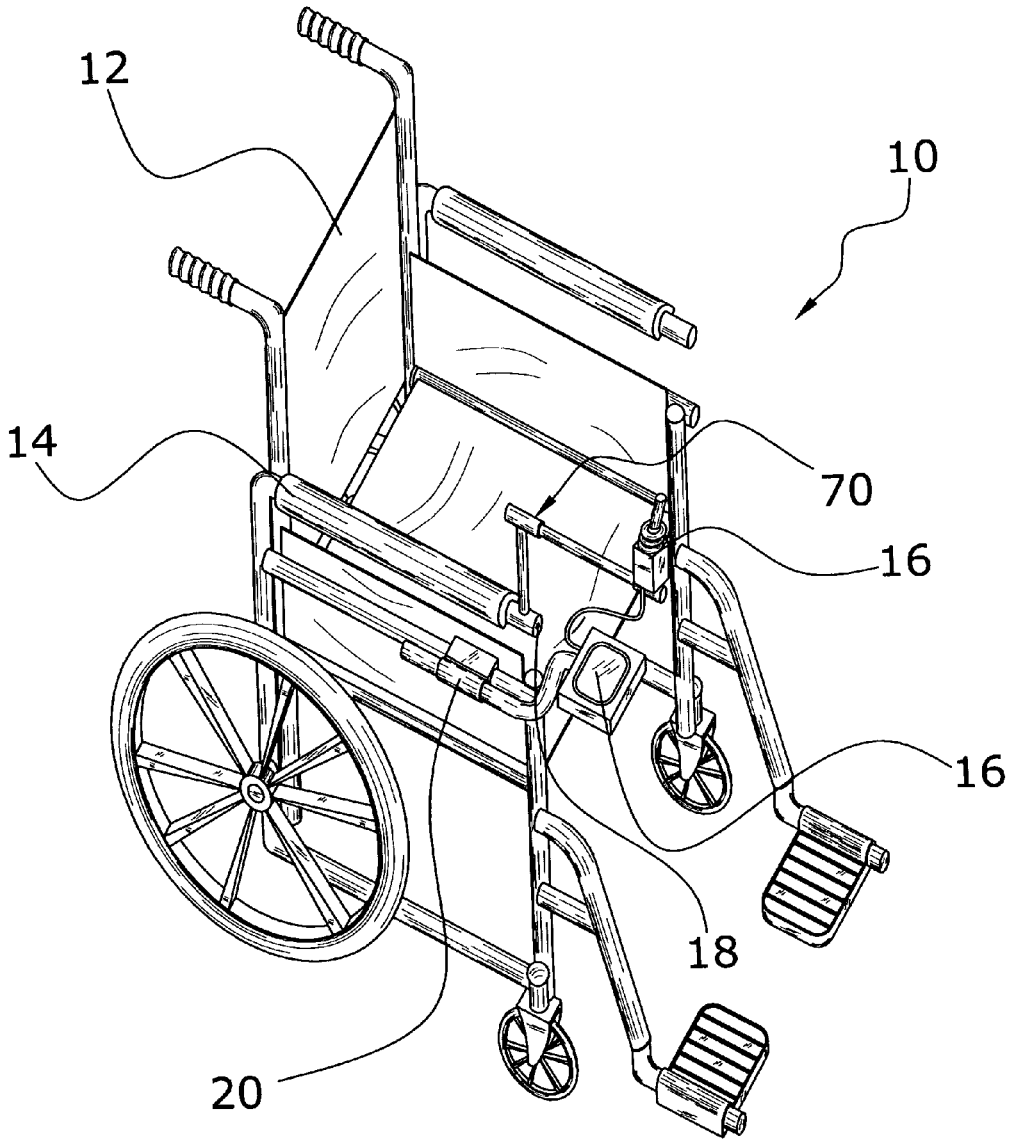
FIG. 11 is an upper perspective view of the present invention in an alternative embodiment showing the extension mount orientated forward.

An alternative embodiment of the invention is shown in FIGS. 10 and 11. An extension mount 70 is attached to the armrest 14 of a wheelchair 12 to position the joystick control module 16 near the chin of a user who does not have use of their hands (e.g. quadriplegic). As shown in FIGS. 10 and 11, the extension mount 70 is adjustable vertically and rotationally to accommodate the user in operation and for ingress or egress to and from the wheelchair 12.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A wheelchair swing away system, comprising:

a mounting bracket attached to a wheelchair, wherein said mounting bracket is comprised of a tube attached to a clamp;

a first mounting rod connected to said mounting bracket;

a second mounting rod connected to said first mounting rod by a second pivot pin, wherein said second mounting rod is slideably adjustable along said second pivot pin; and a control mount connected to said second mounting rod by a first pivot pin.

2. The wheelchair swing away system of claim 1, wherein said first mounting rod is slideably adjustable within said tube of said mounting bracket.

3. The wheelchair swing away system of claim 1, wherein said first mounting rod is rotatably adjustable within said tube of said mounting bracket.

4. The wheelchair swing away system of claim 1, wherein said second mounting rod is comprised of a first rod and a second rod.

5. The wheelchair swing away system of claim 4, wherein said second rod is rotatably adjustable about said first rod.

6. The wheelchair swing away system of claim 4, wherein said first pivot pin is rotatably restrained by a first spring located within said first rod.

7. The wheelchair swing away system of claim 4, wherein said second pivot pin is rotatably restrained by a second spring located within said second rod.

8. The wheelchair swing away system of claim 1, wherein said second mounting rod is rotatably adjustable about said second pivot pin.

9. The wheelchair swing away system of claim 1, wherein said control mount is rotatably adjustable about said first pivot pin.

10. The wheelchair swing away system of claim 1, wherein said control mount is slideably adjustable along said first pivot pin.

11. A wheelchair swing away system, comprising:

a mounting bracket comprised of a tube attached to a clamp, wherein said clamp is adjustably connectable to varying sized wheelchair structure;

a first mounting rod slideably and rotatably adjustable within said tube of said mounting bracket;

a second mounting rod connected to said first mounting rod by a second pivot pin, wherein said second mounting rod is comprised of a first rod and a second rod, wherein said second rod is rotatably adjustable about said first rod, wherein said second mounting rod is rotatably adjustable about and slideably adjustable along said second pivot pin, and wherein said second pivot pin is rotatably retained by a second spring located within said second rod; and a control mount connected to said second mounting rod by a first pivot pin, wherein said control mount is rotatably adjustable about and slideably adjustable along said first pivot pin, and wherein said first pivot pin is rotatably retained by a first spring located within said first rod.

12. A wheelchair swing away system, comprising:

a mounting bracket attached to a wheelchair, wherein said mounting bracket includes a clamp;

a first mounting rod connected to said mounting bracket;

a second mounting rod connected to said first mounting rod by a second pivot pil; and a control mount connected to said second mounting rod by a first pivot pin;

wherein said control mount is slideably adjustable along said first pivot pin.

13. A wheelchair swing away system, comprising:

a mounting bracket attached to a wheelchair, wherein said mounting bracket includes a clamp;

a first mounting rod connected to said mounting bracket;

a second mounting rod connected to said first mounting rod by a second pivot pin; and a control mount connected to said second mounting rod by a first pivot pin, wherein said first pivot pin is rotatably restrained by a first spring located within said first rod.

14. A wheelchair swing away system, comprising:

a mounting bracket attached to a wheelchair, wherein said mounting bracket includes a clamp;

a first mounting rod connected to said mounting bracket;

a second mounting rod connected to said first mounting rod by a second pivot pin, wherein said second pivot pin is rotatably restrained by a second spring located within said second rod; and a control mount connected to said second mounting rod by a first pivot pin.

* * * * *